United States Patent [19]

Daniell

[11] Patent Number: 4,606,673

[45] Date of Patent: Aug. 19, 1986

[54] SPAR BUOY CONSTRUCTION HAVING PRODUCTION AND OIL STORAGE FACILITIES AND METHOD OF OPERATION

[75] Inventor: Alan F. Daniell, Epsom, England

[73] Assignee: Fluor Corporation, Irvine, Calif.

[21] Appl. No.: 680,361

[22] Filed: Dec. 11, 1984

[51] Int. Cl.[4] ..... B65D 89/10

[52] U.S. Cl. ..... 405/210; 114/256; 114/265; 405/195

[58] Field of Search ..... 405/195, 203–208, 405/210; 114/256, 264, 265

[56] References Cited

U.S. PATENT DOCUMENTS

| | | | |
|---|---|---|---|
| Re. 29,478 | 11/1977 | Goren et al. | 405/205 X |
| 3,271,964 | 9/1966 | Wolff | 405/207 |
| 3,322,087 | 5/1967 | Tucker . | |
| 3,327,667 | 6/1967 | Manning . | |
| 3,360,810 | 1/1968 | Busking | 114/256 |
| 3,470,836 | 10/1969 | Daniell . | |
| 3,507,238 | 4/1970 | Yeong-Wai Chow | 114/256 |
| 3,779,193 | 12/1973 | Hirata | 114/0.5 T |
| 3,837,310 | 9/1974 | Toyama | 114/0.5 T |
| 3,880,102 | 4/1975 | Biewer | 114/256 |
| 3,889,477 | 6/1975 | Tam | 61/46.5 |
| 3,921,557 | 11/1975 | Kapteijn et al. | 14/0.5 T |
| 4,059,065 | 11/1977 | Clark et al. | 114/256 |
| 4,274,356 | 6/1981 | Finsterwalder | 114/265 |

*Primary Examiner*—Dennis L. Taylor

*Attorney, Agent, or Firm*—Poms, Smith, Lande & Rose

[57] ABSTRACT

A stabilized spar buoy construction for deep sea operations including an elongated submerged hull having a selected volume and a selected water plane area, mooring lines connecting the bottom portions of the hull with the sea bottom, said hull having oil storage chambers and variable ballast chambers to establish and maintain a constant center of gravity of the spar buoy at a selected distance below the center of buoyancy of the spar buoy, a riser system extending through a through passage-way in the hull, a riser float chamber having pitch oscillations of the same amplitude as the hull and maintaining tension on the riser system and minimizing pitch motions therein, the bending stresses in the riser system between the sea floor and the riser float chamber being minimized by maintaining a selected constant distance between the center of gravity and the center of buoyancy under different load conditions of the spar buoy, said variable ballast chambers in the hull extending above the oil storage chambers. A method of maintaining constant draft and constant selected distance between the center of gravity and center of buoyancy of a spar buoy.

17 Claims, 10 Drawing Figures

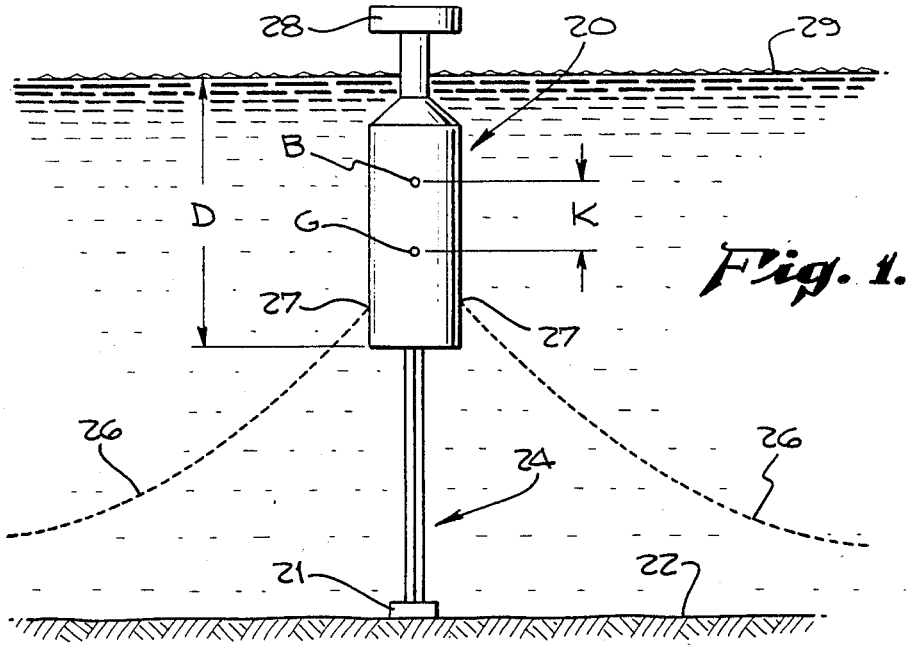
Fig. 1.
Fig. 10.
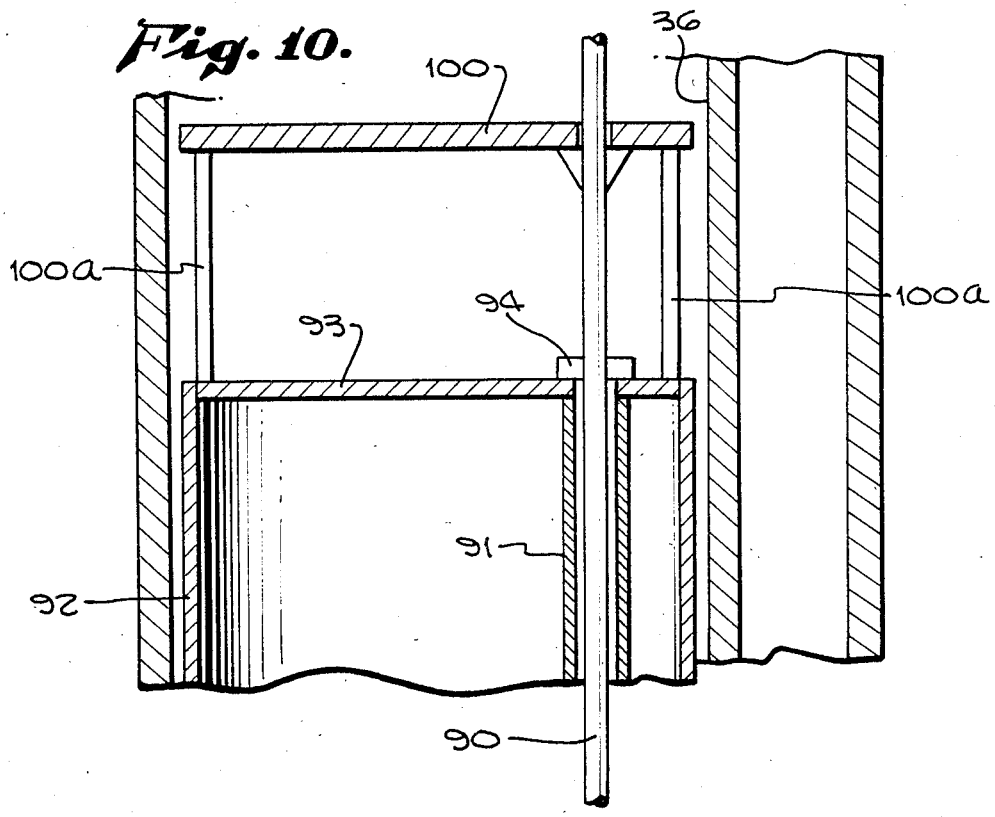

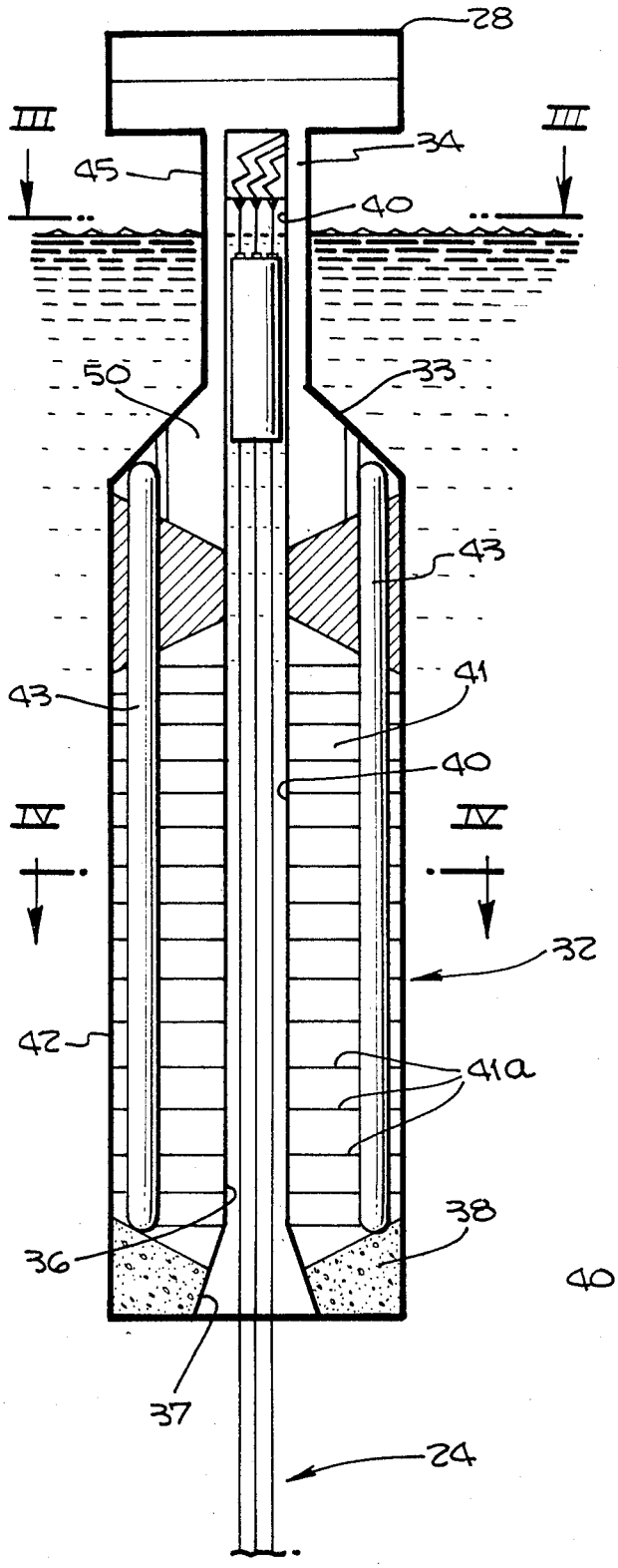
Fig. 2.
Fig. 3.
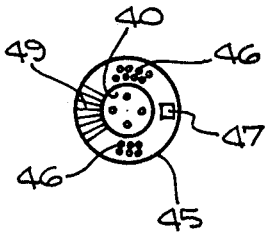
Fig. 4.
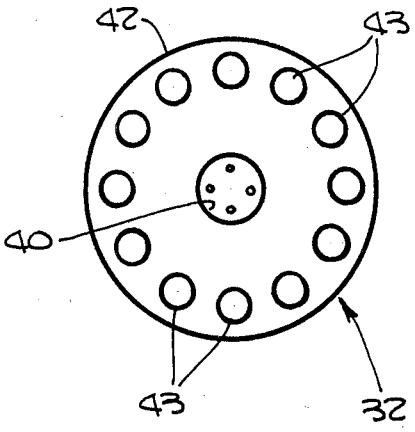

SPAR BUOY CONSTRUCTION HAVING PRODUCTION AND OIL STORAGE FACILITIES AND METHOD OF OPERATION

BACKGROUND OF THE INVENTION

The present invention relates to a spar buoy construction having a production deck, oil storage facilitates, and a riser system connecting a subsea well installation on the sea floor with the production deck, the riser system extending through a central longitudinal passageway in the spar buoy hull means. The spar buoy construction is adapted to operate in water depths of from 1,000 to at least 7,000 feet and under conditions of severe exposure.

Prior proposed offshore constructions have included jacket type structures fixed to and resting upon the sea floor, a guyed tower construction such as shown in U.S. Pat. No. 3,903,705 and further described in offshore magazine of April 1983 pages 47–60 inclusive, and tension mooring platforms such as shown in U.S. Pat. Nos. 3,780,685 and 3,648,638. Offshore oil storage capacity is desired at at least a minimum of 500,000 barrels and preferably from 750,000 to 1,000,000 barrels. It does not appear feasible to provide oil storage of over 100,000 tons in association with the jacket type, guyed tower, and tension mooring platform constructions briefly mentioned above. The present objective is to provide an offshore floating construction which will include integrated crude oil storage at reasonable costs combined with production facilities and with a riser system associated with the floating oil storage structure. One of the advantages of a spar buoy construction for this objective is that the natural period in heave, pitch, and roll motion may be made longer than the period of an expected ocean wave. Motion of a spar buoy construction may be made less than motion of a semi-submersible or of a floating vessel of generally horizontal profile.

An important parameter to be considered in offshore structures of this spar buoy type is the distance between the center of gravity of the entire structure and the center buoyancy of the structure. It is necessary for the center of gravity to be below the center of buoyancy for stability. If the distance between the gravity and buoyancy centers is long then the structure will assume a short natural period in pitch and roll and the dynamic motion response to waves will be large. If the buoyancy center to gravity center is a short distance, the structure will assume greater tilt or inclination in response to wind and current conditions but have a reduced response to wave conditions. An optimum or a preferred distance between the center of gravity and center of buoyancy of a structure may be determined and if such center of buoyancy to center of gravity distance is maintained constant, motion stability of the structure will be enhanced.

Another parameter considered involves riser systems of more than a 1,000 feet in depth. Such riser systems are subjected to substantial horizontal loading and require either some form of lateral support or tensioning. In the tension moored platform, simple tensioning of the riser system is possible. In a semi-submersible vessel heave compensators are necessary to maintain constant tension in the risers.

Floating oil storage units of spar buoy type are shown in U.S. Pat. Nos. 3,921,557 and 3,360,810. The latter patent shows an external riser system having a vertically elongated hull for oil storage and adjacent the top thereof side tanks to provide variable balance ballast to maintain a constant draft of the vessel. In U.S. Pat. No. 3,921,557 a flexible riser means extends through a central passageway of a spar buoy type hull, the riser being provided with tensioning means and the hull providing storage for oil.

Various types of offshore oil storage vessels have been proposed such as shown in U.S. Pat. Nos. 3,507,238; 3,880,102; 3,889,477; 3,837,310; 4,059,065. In general the oil storage structures of these patents seeks to maintain constant weight during filling and discharge of oil by varying the water ballast to maintain generally constant draft conditions for the vessel.

In U.S. Pat. No. 3,470,836 a subsea well head structure provides an elongated hull not used for oil storage but to provide a central passageway through which a riser extends, the riser having a float to maintain the riser under suitable tension. The hull has a top submerged work chamber and is normally located entirely below the surface of the water.

In general offshore structures have been designed specifically for one or two functions such as storage of oil or drilling and production facilities with oil storage being separate from such facilitates.

SUMMARY OF THE INVENTION

The present invention contemplates a novel spar buoy construction which provides oil storage of desired capacity, the spar buoy construction supporting a production deck for suitable production facilities, and the construction providing a connection to a riser system from a multiple well head sea floor installation, the construction providing suitable tension for the riser lines which extend through the spar buoy construction. The present invention provides substantially constant draft, enhanced stability by constant location of the center gravity of the entire mass, and a spar buoy having a natural period greater than the period of expected waves. The spar buoy construction provides means for maintaining the center of gravity of the entire mass at a selected position while maintaining constant draft and also maintaining a selected distance between the center of gravity and center of buoyancy. The invention contemplates a spar buoy construction which readily accommodates a riser system and provides means therewithin for maintaining a constant uniform tension on a plurality of separate riser pipes extending from the sea floor.

The primary object of the present invention is to provide a spar buoy of novel construction which provides oil storage facilities, production facilities, and a riser system.

An object of the present invention is provide such a spar buoy of novel construction which provides enhanced stability in a floating catenary moored condition.

Another object of the present invention is provide a spar buoy construction wherein oil storage chambers and variable ballast chambers are arranged in novel fashion to provide not only constant draft but also a constant location of the center of gravity thereof with respect to the center of buoyancy thereof.

Another object of the present invention is to provide a spar buoy construction having novel means for connecting the upper end of the riser system to production facilities.

A further object of the present invention is provide a spar buoy construction in which the draft and the distance between the center of buoyancy and center of gravity remain substantially constant during varying ocean conditions and also during inflow and outflow of oil in the storage chambers.

The present invention particularly contemplates a floating structure of spar buoy type which includes oil storage capacity and variable ballast capacity adapted to be anchored by catenary mooring lines at a subsea well location. The spar buoy structure includes an elongated hull means vertically positionable in water, the hull means having an oil storage chamber for storing oil and extending for a major portion of the height of the structure. Within the hull means are also a plurality of vertically extending ballast chambers which extend from the bottom portion of the oil storage chamber to above the top portion of the oil storage chamber means to provide means for ballasting to maintain constant draft and constant location of center of gravity of the mass to compensate for variable loads. Within the hull means are means for introducing oil into the storage chamber and for removing water therefrom to maintain the oil storage chamber in liquid full condition and also means for regulating the amount and location of ballast in the ballast chamber to maintain the center of gravity of the entire mass at a selected location and at a selected distance from the center of buoyancy of the structure while the amount of oil in the oil storage chamber is varied. The structure also includes an axial longitudinal passageway means therethrough for receiving a riser system having a plurality of riser pipes which are connected to a riser buoyancy means contained within the passageway for uniformly tensioning each of the riser pipes entering the hull means. The upper ends of the riser pipes are extended above a deck supported by the riser buoyancy means in the central passageway for connection by flexible lines to the fixed production facilities, the upper ends of the riser pipes being readily available and accessible.

The invention also contemplates a method of maintaining a constant draft and a constant selected distance between the center of gravity and center of buoyancy of the spar buoy structure to provide stable motion characteristics in which the method includes the steps of causing oil to flow into the oil storage chamber while displacing water therefrom, causing water to flow into and fill certain initially empty variable ballast chambers until the aggregate weight of the water in said certain ballast chambers and the weight of the oil and water in the oil storage chamber is equivalent to the initial aggregate weight of the water filled oil chamber; and controlling the amount and height of water entering certain of said variable ballast chambers to maintain the center of gravity of the spar buoy at the said selected position.

Other objects and advantages of the present invention will be readily apparent to those skilled in the art from the following description of the drawings in which an exemplary embodiment of the invention is shown.

BRIEF DESCRIPTION OF THE DRAWINGS

FIG. 1 is a schematic elevational view of a spar buoy construction embodying this invention associated with a subsea well installation.

FIG. 2 is an enlarged fragmentary schematic view of the spar buoy construction shown in FIG. 1.

FIG. 3 is a sectional view taken in the horizontal plane indicated by line III—III of FIG. 2.

FIG. 4 is a horizontal sectional view taken in the plane indicated by line IV—IV of FIG. 2.

FIG. 10 is a fragmentary enlarged view of the upper portion of the riser system.

DETAILED DESCRIPTION OF THE INVENTION

Figure 6:
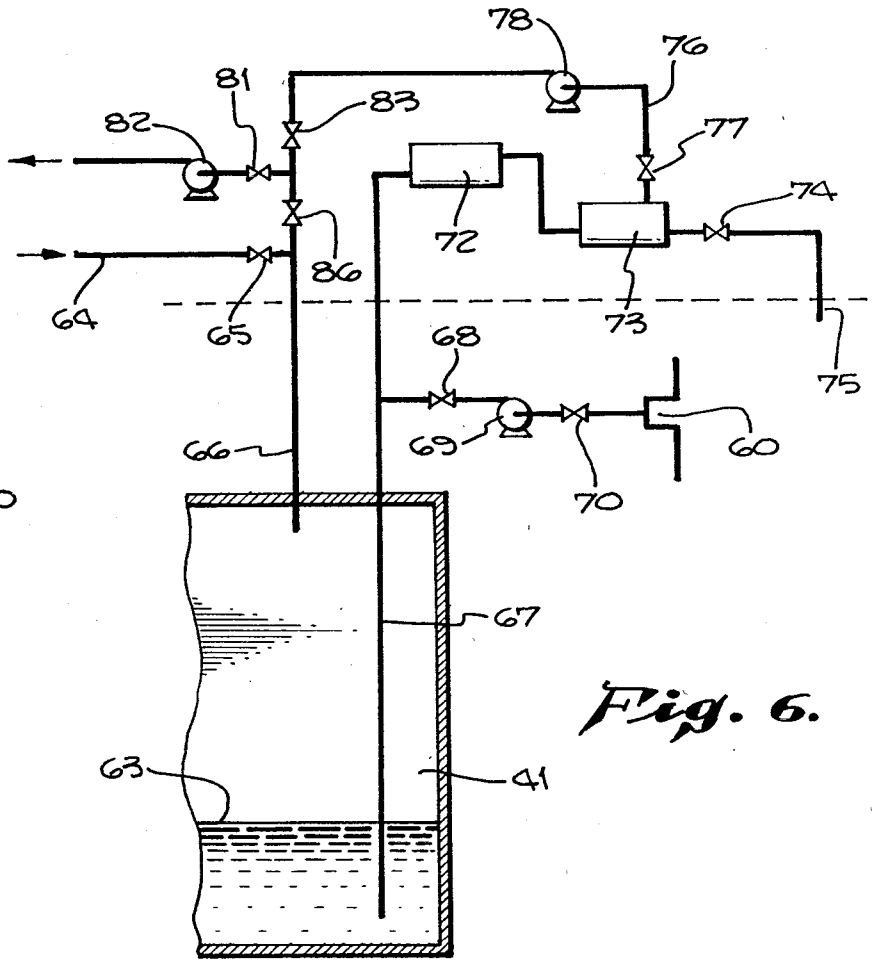
FIG. 6 is a schematic view of a crude oil storage and load out system used in this spar buoy construction, the oil storage chamber being partially schematically shown.

In FIG. 1 a spar buoy construction generally indicated at 20 embodying this invention is shown. The spar buoy 20 may be located over a subsea installation 21 on the sea floor 22 and is connected thereto by a riser means 24, in this example including a plurality of riser pipes as later described. Spar buoy 20 may be suitably anchored by a plurality of catenary mooring lines 26 connected around the periphery of spar buoy 20 at 27 and connected to suitable anchor means (not shown) located on sea floor 22. Spar buoy 20 supports a platform deck 28 at a selected height above the water line 29 to provide suitable clearance of the platform deck structure above expected wave lengths. Spar buoy 20 has a center of gravity exemplarily illustrated at "G" located below a center of buoyancy "B", the locations of the center of gravity "G" and center of buoyancy "B" being schematically illustrated only and not representing actual locations for the structure shown.

The spar buoy construction 20 comprises a floating structure limited in lateral movement by the catenary mooring lines 26 and having a selected draft "D" for maintaining the platform structure 28 a selected height, for example, 25 meters above the water line 29. Riser means 24 extends upwardly into and through the spar buoy 20 (FIG. 2), the upper end of the riser means being maintained at a selected distance above sea bed 22 and relatively free vertical oscillating movement between the spar buoy and the riser means occurs as later described.

The center of gravity "G" represents the center of gravity of the entire mass including the structural components of the spar buoy platform 28, equipment and stores carried by the spar buoy, and the weight of any oil and water carried by the spar buoy 20. The center of buoyancy "B" of the spar buoy construction is located above the center of gravity "G" and it is desirable that the distance "K" between the center of gravity and center of buoyancy be maintained relatively constant. In the selection of the relationship between the center of buoyancy and center of gravity it will be understood that if the distance "K" between the center of buoyancy "B" and center of gravity "G" is great the spar buoy will be very resistant to pitch and roll moments arising from winds and sea currents but will have a relatively short natural period so that dynamic motions caused by waves may be large. If the distance "K" between the center of buoyancy "B" and center of gravity "G" is small the spar buoy will have greater inclination in response to wind and sea current forces but the response to wave action will be reduced. The present invention provides means for maintaining such distance "K" between the center of buoyancy "B" and center of gravity "G" approximately constant as well as the draft "D" of the floating spar buoy so that optimum behavior of the spar buoy will be obtained. Such optimum conditions of behavior may be maintained by achieving a selected compromise between the behavior patterns mentioned above.

In detail, the spar buoy construction 20 comprises an elongated hull means 32 of hollow cylindrical prismatic form. Hull means 32 at its upper end merges into a tapered or conical portion 33 which terminates in a cylindrical top portion 34 which extends upwardly through the water surface to support the production deck 28 at a selected height above the water surface 29.

Hull means 32 includes an axial or longitudinal through passageway 36 having a downwardly and outwardly flared bottom opening 37, the passageway above opening 37 being of uniform diameter and extending upwardly through cylindrical top portion 34 to the production deck 28. The axial passageway 36 receives the upper portion of riser system 24 as later described.

Means for vertically positioning hull means 32 in the sea water may comprise fixed or permanent ballast means 38 provided at the bottom of hull 32. Fixed ballast 38 may include any suitable ballast material as, for example, concrete of selected weight. At the upper end of hull means 32 and below the conical portion 33 buoyancy means 39 may be provided. Such buoyancy means 39 is permanent and in this example may include a pressure-resistant closed-cell foam material occupying a sufficient volume of the hull means at the top to provide with the fixed ballast 38 vertical positioning of the hull means in the sea water. The hull means at the permanent buoyancy means 39 may be provided with ports (not shown) so that external and internal fluid pressures acting on this portion of the hull means may be maintained in balance. In this example of the hull means permanent buoyancy means 39 may be located with its top approximately 35 meters below the surface of the water and the bottom end of the hull means carrying the fixed ballast 38 may be located approximately 175 meters below water surface 29.

Between the fixed ballast means 38 and the permanent buoyancy means 39 the hull means is provided with oil storage chamber means 41 which comprises an annular volume or space, the inner cylindrical wall 40 forming the central passageway 36 and the outer wall 42 forming the outside skin of hull means 32. The oil storage means 41 may comprise a plurality of horizontally arranged oil storage spaces 41*a* each intercommunicating with the other to provide flow of oil therebetween.

Also within hull means 32 are a plurality of vertically extending variable ballast tanks 43, such tanks 43 being parallel to the axis of the hull means and radially circularly spaced uniformly about said axis and located inwardly of the cylindrical outer wall 42. The variable ballast tanks 43 are of cylindrical prismatic shape and extend from adjacent the bottom of hull 32 at fixed ballast means 38 through the oil storage chamber means 41, through the permanent buoyancy means 39 and into the conical portion 33 of the spar buoy. The upper ends of the variable ballast tanks 43 are located and provide ballast volume above the upper end of the oil storage chamber means 41 for a purpoe later described. FIG. 4 indicates approximately 12 variable ballast tanks arranged in a circle around the axis of the central passageway. The total volume of the variable ballast tanks 43 as measured to the tops of the oil storage chamber, is related to the total volume of the oil storage chamber means 41 in a ratio of 0.13 where the oil to be stored has a specific gravity of 0.85. The extension of the variable ballast tanks above the top of the oil storage chamber compensates for variable quantities of oil stored as later described.

Above the permanent buoyancy means 39 and in the conical portion 33 of the hull means there may be provided a work chamber having various facilities for pumping fluids used in connection with the operation of the spar buoy. Such facilities include necessary pumps and valves etc for controlling the flow of variable ballast and the volume of oil and water in the oil storage chamber 41. Some of the latter equipment may be connected to equipment on the production deck as described later.

As shown in FIG. 3 the reduced cylindrical portion 34 of the spar buoy construction may include an annular space provided by an outer cylindrical wall 45 spaced radially outwardly from the inner cylindrical wall 40 defining the central axially passageway 36 at the top portion 34. In the annular space there may be provided a plurality of pipeways 46 a vertical elevator 47, and diametrically opposite thereto, stairs 49 which lead from the production decks 28 to the pump room 50 in the conical portion 33 of the hull.

Figure 5:
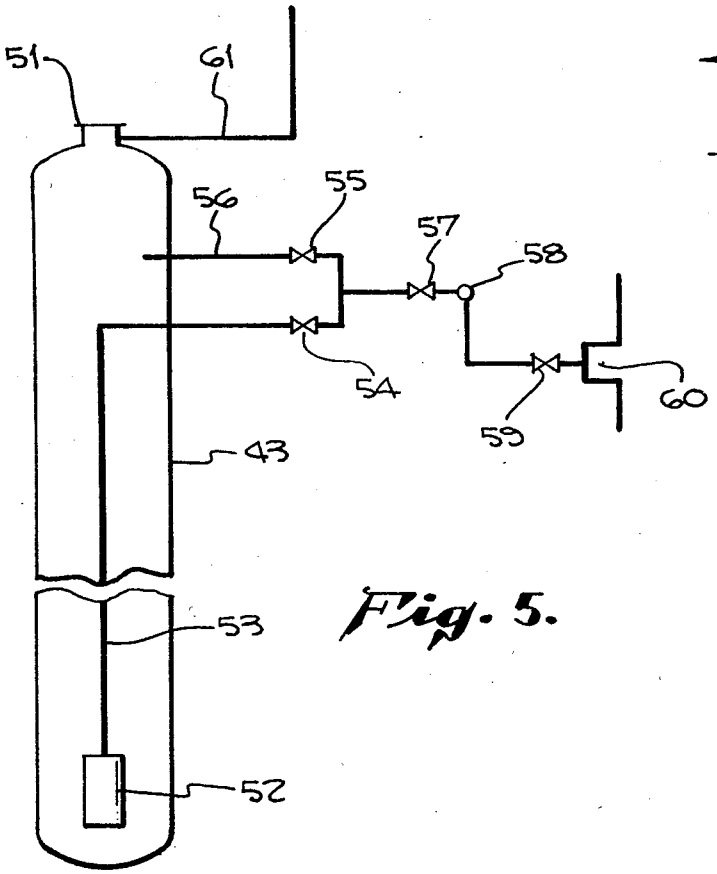
FIG. 5 is a schematic view showing a variable ballast control system used in this spar buoy construction.

In each of the variable ballast tanks 43 means are provided for controlling the amount of ballast therein. As shown in FIG. 5 each tank 43 includes an access hatch 51 at the top of the tank and in the area of the pump room 50. Within each tank 43 is a submersible pump 52 of suitable type connected through a pipe line 53 to an emptying valve 54 located in the pump room. Emptying valve 54 may be connected in parallel with a filling valve 55 adapted to pass water through line 56 into the ballast tank 43. Both valves 54 and 55 may be connected through a valve 57 to a common header pipe 58 interconnecting adjacent tanks 43. Header pipe 58 may be connected through a valve 59 to a sea chest 60. It will thus be apparent that each of the variable ballast tanks 43 can be readily filled or partially filled with selected amounts of water in order obtain desired ballast conditions. The access hatch 51 may be supplied with an air vent 61. Water in the variable ballast tanks 43 does not come in contact with oil and may be discharged into the sea without pollution thereof.

The oil storage chamber means 41 is provided with means for feeding oil into the oil storage chamber and for withdrawing water in the oil storage chamber simultaneously therewith and at the same flow rates. As shown in FIG. 6 the oil storage chamber 41 is shown with an oil-water level at 63. Initially, the oil storage chamber 41 is completely filled with sea water to the top. Oil from the production facilities or from the subsea well facilities may be introduced through production line 64, through valve 65 and into the top portion of tank 41 thru feed line 66. Since the specific gravity of oil (E.G. 0.85) is less than the specific gravity of water, (E.G. 1.0) as oil is introduced into the top of the chamber 41 the same volume of water is withdrawn from the bottom of tank 41 by a water header line 67. The water header line 67 communicates with a header tank 72 located on the production deck and connected to an oil water separator 73. The separator 73 is connected through valve 74 to a discharge line 75 which discharges the separated water into the sea. The oil-water separator 73 is also provided with a line 76 having a valve 77 for discharging the separated oil to a pump 78 for suitable distribution to storage or tanks.

Header line 67 also communicates thru a valve 68 with a sea water pump 69 which may discharge water from the sea chest 60 through valve 70 for filling tank 41 with water.

Oil from production, in the event it is not to be stored in the oil storage tank, may be pumped directly to an offshore tanker (not shown) through valves 86, 81 and through a cargo booster pump 82. Oil from the separator may also be pumped through pump 78 to the cargo booster pump 82 through valve 83.

Figure 7:
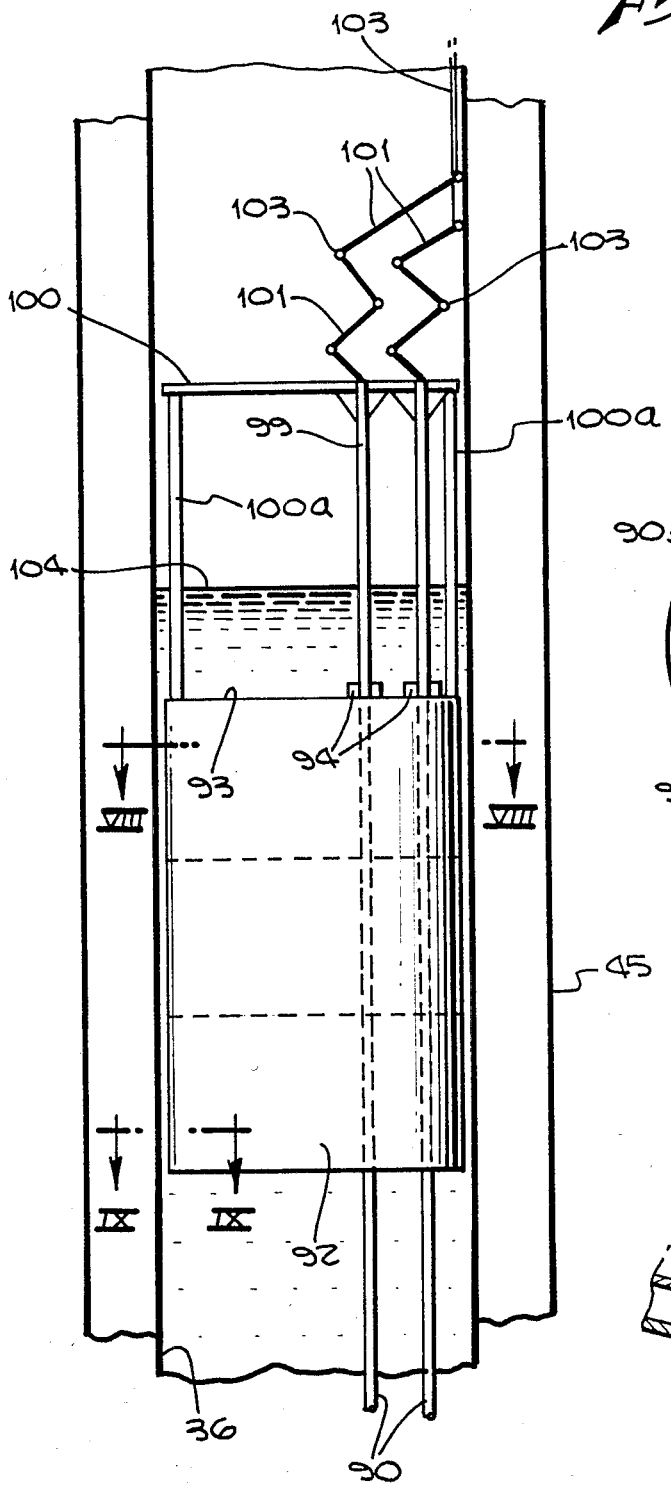
FIG. 7 is an enlarged schematic view of the top portion of the riser system associated with the spar buoy construction shown in FIG. 1.

Riser means 24 as previously generally described extends upwardly from subsea installation 21 through passageway 36 of the hull means 32 and may comprise a plurality of separate independent riser pipes 90 FIGS. 7, 10. Each riser pipe 90 extends through a tube 91 for passing through a riser float chamber means 92 of cylindrical form moveable along the axis of passageway 36 and relative to spar buoy hull means 32. The top wall 93 of the buoyant chamber 92 is provided a suitable adjustable connection 94 to the upper end of each riser 90 to maintain chamber 92 a selected distance above the sea bed. The adjustable connections 94 for each riser provides repartition of the tension between individual risers 90 to ensure that all risers 90 are under equal tension. The buoyant chamber 92 is of such size and volume as to provide suitable buoyancy for tensioning the plurality of riser pipes 90.

Figure 8:
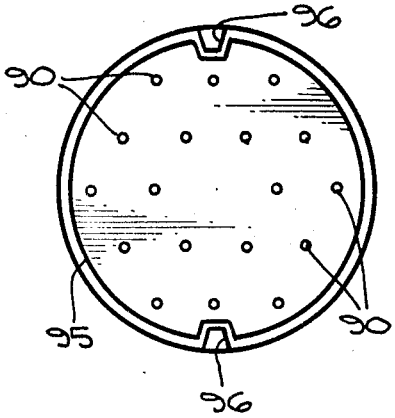
FIG. 8 is a traverse sectional view taken in the plane indicated by line VIII—VIII of FIG. 7.
Figure 9:
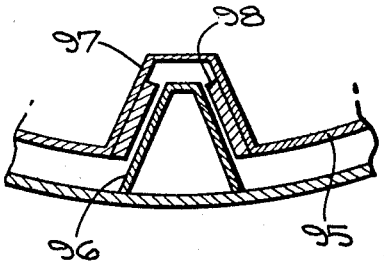
FIG. 9 is an enlarged fragmentary sectional view taken in the plane indicated by line IX—IX of FIG. 7.

Buoyant chamber means 92 has an outer diameter which is less than the inner diameter of the passageway 36 to permit relative vertical movement of chamber means 92 in the passageway 36, such movement being vertically guided to prevent twisting of the chamber 92 about its longitudinal axis by means of guide ribs 96 of suitable V shape in diametrically opposite relation as seen in FIG. 8. Guide ribs 96, provided on the inner surface of the passageway means 36, extend for the length of such passageway or for only a selected distance at the upper portion of the passageway which will exceed the length of vertical movement of chamber 92. The guide ribs 96 are received within a complementary V shaped grooves 97 provided in cylindrical wall 95 of the buoyant chamber means 92. Relative movement of the buoyant chamber 92 along the guide ribs 96 is facilitated by the provision of vertically extending antifriction pads 98 in groove 97 and opposite surfaces of the guide ribs 96. The pads 98 are preferably of an antifriction material which may be of synthetic resin having a low coefficient of friction when lubricated by water. The riser tensioning buoyant chamber means 92 is substantially free within the axial passageway means 36 to permit oscillation vertically of the hull means 32 and relative rotational movement is prevented by the interengagement of guide ribs 96 and grooves 97.

As best seen in FIG. 7 the upper portion 99 of each riser 90 extends above top wall 93 of the buoyant chamber 92 and terminates above circular deck 100 in passageway means 36. The deck 100 may be supported by columns 100*a* extending from the top wall 93 of the riser float means 92. The upper end of the each riser 99 may be connected to articulated rigid pipe sections 101 joined together by suitable swivel flexible joints 102 such as those manufactured by FMC Corporation under the name Chiksan. At the upper end of the articulated sections there may be attached suitable piping or lines 103 for transporting the fluid in the risers to suitable production facilities on production deck 28.

In the riser system described above passageway means 36 has a bottom open end in communication with the sea water which may rise in the passageway to a level indicated at 104. When buoyant chamber means 92 is attached to each of the risers and the risers adjustably connected at connections 94 the buoyant chamber will be held at a selected constant height above sea bed 22. The water level may rise and fall in passageway means 36 by action of the tide and to a limited extent by changes in water pressure at the bottom of the spar buoy due to the effect of wave action. In this example it is contemplated that the buoyant chamber means 92 will usually be totally submerged and change in buoyancy due to variations in water level will be confined to that due to the change in submerged volume of the riser system above the top surface of the buoyant chamber means.

In an example of such a system having eighteen risers the buoyant chamber means 32 may have a diameter of 9.50 meters, a height of 15 meters with a total displacement of about 1000 tons. The weight of the buoyant chamber means and its appurtenances is estimated at 150 tons. An upward force of approximately 850 tons is then available for tensioning the risers and this force could be varied if desired by partial flooding of the buoyant chamber means 92.

The riser system 24 together with the buoyant chamber means 92 and the manner of adjustable connection of the upper ends of the risers to the production deck provides a riser system which is substantially isolated from vertical motions of hull means 32. Hull means 32 serves to protect the risers 90 from wave and ocean current action for those riser portions which are received within the passageway means 36. Thus the upper portion of the riser system is substantially protected by the hull means and connected to the production facilities by articulated pipe sections which compensate for relative vertical movement.

The arrangement of the oil storage chamber and variable ballast tanks in the hull means facilitates the maintenance of a constant draft "D" and also a constant distance "K" between the center of gravity of the entire mass and the center of buoyancy thereof. Maintenance of such constant draft and location of the center of gravity with respect to the center of buoyancy enhances the stability of the spar buoy construction.

The method of maintaining the center of gravity at a selected position may be best understood by first considering an example in which center of gravity position changes. Assuming a spar buoy generally similar to that described above, but in which the variable ballast tanks are located above the oil storage volume, as in most previous designs a fixed weight including the hull and topside structure, production equipment and accessories, permanent ballast, and weight of the catenary mooring lines may be estimated at approximately 110,000 metric tons having a center of gravity 80 meters above a datum reference corresponding to the bottom wall of the cylindrical hull. An exemplary volume of crude oil storage tank space is 165,000 cubic meters. The center of the oil storage volume is 55 meters above the datum reference. The variable ballast tanks extend to an average elevation of 110 meters above the datum reference. Without oil in the oil storage chamber and with the oil storage chamber completely filled with water and with empty variable ballast tanks the height of the center of gravity above the datum reference may be calculated as shown below:

| Item | Weight (Tons) (m.) | Ht. of C.G. above datum (Tons-m.) | Weight Moment |
|---|---|---|---|
| Fixed weight | 110,000 | 80 | 8,800,000 |
| Water in Oil Storage Tanks | 165,000 | 55 | 9,075,000 |
| Total | 275,000 | | 17,875,000 |

Height of C.G. $= \frac{17,875,000}{275,000} = 65$ m.

When the oil storage tanks are filled with oil with a weight of 145,000 tons corresponding to a specific gravity of 0.85 it is necessary to allow 25,000 tons of water to enter the variable ballast tanks to maintain a constant draft (165,000−140,000=25,000 tons). Then calculation of center of gravity is similar to above and is set forth below:

| Item | Weight (Tons) (m.) | Ht. of C.G. above datum (Tons-m.) | Weight Moment |
|---|---|---|---|
| Fixed weight | 110,000 | 80 | 8,800,000 |
| Oil in Storage Tank | 140,000 | 55 | 7,700,000 |
| Water in Ballast Tanks | 25,000 | 100 | 2,750,000 |
| Total | 275,000 | | 19,250,000 |

Height of C.G. $= \frac{19,250,000}{275,000} = 70$ m.

Thus, while maintaining constant draft (center of buoyancy at the same position), the addition of 25,000 tons of water causes a change in position of the center of gravity in this example to 70 meters.

In the method of this invention assuming oil of specific gravity of 0.85 the ratio of the total volume of the variable ballast tanks to the total volume of the oil storage chamber is calculated as 1−0.85 divided by 2−0.85 which is equal to approximately 0.13. It is also assumed that the fixed weight location is unchanged. The volume of the oil storage tanks now 165,000 cubic meters and that of variable ballast tanks 25,000 cubic meters and both are centered at 62.5 meters above the datum reference that is the bottom of the hull means.

With the oil storage tanks full of water:

| Item | Weight (Tons) (m.) | Ht. of C.G. above datum (Tons-m.) | Weight Moment |
|---|---|---|---|
| Fixed weight | 110,000 | 80 | 8,800,000 |
| Water in oil storage tanks | 165,000 | 62.5 | 10,300,000 |
| Water in variable ballast tanks | 0 | | |
| Total | 275,000 | | 19,100,000 |

Height of C.G. $= \frac{19,100,000}{275,000} = 69$ m.

With the oil storage chamber full of oil a calculations are given below:

| Item | Weight (Tons) (m.) | Ht. of C.G. above datum (Tons-m.) | Weight Moment |
|---|---|---|---|
| Fixed weight | 110,000 | 80 | 8,800,000 |

-continued

| Item | Weight (Tons) (m.) | Ht. of C.G. above datum (Tons-m.) | Weight Moment |
|---|---|---|---|
| Oil in storage tank | 140,000 | 62.5 | 8,700,000 |
| Water in variable ballast tanks | 25,000 | 62.5 | 1,800,000 |
| Total | 275,000 | | 19,100,000 |

Height of C.G. $= \frac{19,100,000}{275,000} = 69$ m.

From the above illustration the height of the center of gravity remains constant at 69 meters irrespective of the proportions of oil and water within the oil storage space. The effect of maintaining the height of the center of gravity "G" constant for all conditions of oil containment, depends upon the correct proportioning of the volumes of oil storage and variable ballast chamber spaces, upon the vertical extent of the both spaces being the same, and upon the form of the spaces being prismatic (horizontal sections are the same at all elevations).

To compensate for other variable weights, the variable ballast tanks extend above the height of the oil storage chamber space. An additional element of variable weight occurs because of consumption of stores and the addition or removal of equipment from the pump room and the production decks. While such weights are much less than the variable weight of the contents of the oil storage space, it is desirable to have means for adjustment of the floating draft to compensate for such weight variations. In the spar buoy construction described above, this requirement is met by extending the variable ballast tanks above the elevation of the top of the oil storage space to provide additional accommodation for ballast.

Under the method of this invention the height of the collective center of gravity can be varied, for example, if the vertical height of the variable ballast tanks is 130 meters and if all of the tanks are one-half full, i.e. filled to 65 meters, the center of gravity of the contents will be 32.5 meters above the bottom of the tanks. However, if half of the tanks are completely filled, that is, filled to 130 meters and the other half completely empty, 0.0 meters, which would still result in the same total weight, the height of the center of gravity will be 65 meters.

With reference to FIG. 6 and operation of the storage and load-out system the water level in header tank 72 may be maintained at a constant elevation of, for example, about 30 meters above sea level. The line 67 extends from the header tank to a point near the bottom of the oil storage space. As oil is produced it may be fed into the oil storage chamber by line 66 which terminates near the top of the oil storage spaces. As oil is fed into the storage chamber spaces, the water below the oil and being displaced will rise up line 67 to the header tank and may be discharged through the separators and to the sea through line 75. When oil is being loaded to the off-shore tanker, water is pumped into the header tank at a volumetric rate corresponding to the rate of loading. Oil discharged through line 66 by booster pump 82 will be under some positive pressure because the weight of the oil column in the oil storage chamber and oil line has a lower specific gravity than the balancing water column maintained in line 67 by the header tank 72. The booster pump 82 provides a rapid loading rate to an off-shore tanker and since pump 82 is working against a low pressure head its power requirement is small.

It should be noted that the cylindrical form of the spar buoy construction is readily capable of resisting differential pressures created by submergence of the hull means in the sea water. If differential pressure is directed outwardly, that is, the internal pressures in the hull means exceed the external pressures of the sea water, the skin of the spar buoy is in a condition of uniform tensile stress. If the differential pressure is directed inwardly, that is, external pressure of sea water against the hull means, circumferential stiffening ribs may be required to resist buckling of the skin. It should be noted that the upper part of the submerged hull means which is filled with pressure resistant closed cellular foam is provided with ports to balance the external and internal pressure, whereas the outer skin of the lower portion of the hull means is subject to outwardly directed differential pressures as the result of the connection to header tank 72.

In further description of the operational characteristics of the above-described spar buoy the distance K determines the pitch response of the spar buoy construction. Heave response of the spar buoy depends on the plan area of the hull means at the water surface relative to the volume and proportions of the submerged portion of the hull means.

It will be noted that the riser float chamber means 92 is free to move relative to the hull means along the longitudinal axis of the hull means. The riser float means 92 is constrained to follow the horizontaL motions, or pitch motions of the platform or buoy construction. The pitch motions of the platform, which are dependent upon its mass, moment of inertia, and the constant "K" do not affect the free movement of the riser float means 92 relative to the hull means. The pitch motions of the platform are transferred to the riser float means 92 by the guide means 96, 97 causing the riser system to perform pitch oscillations of the same amplitude as those of the platform. Since the riser float means 92 and the platform move equally in the pitch mode, there is no effect on the riser connections which are attached at one end to the float means 92 and at the other end to the platform 28. However the pitch motions of the riser float means 92 will induce bending stresses in the risers 90, the lower ends of which are fixed at the sea bed. It is important to minimize these motions by a suitable choice of the constant "K" and of maintaining this optimum value of "K" constant under all load conditions.

Determination of the optimum distance "K" between the center of gravity CG and center of buoyancy CB of the spar buoy construction also includes the consideration of wind or current forces which may cause a tilt of the platform. The disturbing moment is the product of the applied force of wind and current and the distance between the center of application of the force and the restraining force, which acts at the point of attachment of the moorings to the submerged hull means. This disturbing moment is reacted to by a stabilizing moment, which is the product of the weight of the platform together with the vertical component of the mooring tension, the distance "K" between the center of buoyancy and the center of gravity, and the tangent of the angle of tilt. If "K" is large the angle of tilt will be less.

Horizontal displacement of the platform in its catenary moorings, as a result of wind or current forces, will cause an inclination or tilt of the riser system, and the "cosine effect" will cause a slight reduction in elevation. In deep water of the order of 1000 feet this effect is small. The tilt of the platform is due to the difference in elevation between the applied force (wind and waves) and the restraint of the catenary moorings. The optimum location of the mooring line attachments to the bottom portion of the hull means will depend on the specific design of the platform.

The draft "D" of the spar buoy construction should be maintained constant to limit the excursions of the flexible connections between the tops of the risers 90 and the platform 28. Since the riser float means 92 is connected, by the risers 90 to the fixed well head installation at the sea bed it will remain at a nearly fixed elevation above the seabed. If the platform is maintained at constant draft, the elevation of the platform itself, and also the upper ends of the flexible riser connections, will vary due to the variations in the mean sea level, because of tides or wind surge, upon which are superimposed heave motions due to waves. In the open sea, or in deep water, tidal and wind surge amplitudes are small, typically in the order of one meter, and the estimated amplitude of wave induced heave in maximum storm conditions is on the order of three meters. The total variation of the difference between the riser float means and platform is estimated to be some four meters. This can easily be accommodated by the arrangement of rigid pipes and interconnecting flexible joints described above. If the platform draft is not held constant, any variation of draft must be added to this variation and would complicate the design of the flexible riser connections.

Also under consideration is the oscillation or pitch of the platform due to wave effects which may be compared to and is an example of a spring-mass system excited by periodic forces. The mass element is the mass of the platform together with the hydrodynamic or "virtual" mass, which may be regarded as the mass of the surrounding water which moves with the platform. These masses have a certain distribution along the vertical axis of the hull means. The spring element comprises the restoring couple force which is a function of "K". The system is lightly damped, that is to say an oscillation, once initiated, will persist for several cycles. A particular mass-spring system will have a natural period. It is well known that such a system will have a very small response to exciting forces with periods substantially shorter than the natural period, but will have large motions when the exciting force has a period close to the natural period.

Ocean waves may have a spectral distribution or range of periods which may extend for two seconds up to perhaps twenty-five seconds. If the natural period of spar buoy construction is determined at 40 seconds, for example, its response will be very little to ocean waves. Since the natural period is inversely proportional to the square root of the "spring" moment, this long natural period means that the "spring" moment must be small. This requires that the constant "K" be small.

Thus to select an optimum value for K the relative importance and probability of occurance of two sets of conditions must be considered; namely, wind or current forces, and waves of long period and the effects of the resulting motions on the operation of the spar buoy construction, particularly the functioning of process equipment and the stresses on the riser system.

A spar buoy construction 20 described above provides an attractive efficient arrangement of offshore crude oil storage with production facilities carried above the surface of the water and with a riser system which is readily associated with a subsea well installation. The stability of the spar buoy construction is enhanced by the above described arrangement which provides constant draft of the hull means and the maintenance of a constant distance "K" between the center of buoyancy and center of gravity of the spar buoy. These features also enhance the operation of the riser system which is maintained under constant tension within the spar buoy construction and which is flexibly connected to the production facilities. The pressurized oil storage and load out system provides economical use of a low head booster pump on the production deck.

Various changes and modifications may be made in the spar buoy construction and riser system described above which fall within the spirit of this invention and all such changes and modifications coming within the scope of the appended claims are embraced thereby.

I claim:

1. In a floating structure including oil storage capacity and production facilities and adapted to be anchored by catenary mooring lines at a subsea well location, the combination of:

a vertical elongated hull means having means to maintain the hull means in vertical position;

said hull means including a vertical oil storage chamber means for storing oil and extending for a major portion of the height of the floating structure;

a plurality of vertical variable ballast chamber means extending from the bottom of the storage chamber means to above the top of the oil storage chamber means and selectively filled with ballast to maintain the center of gravity of the structure a selected distance from the center of buoyancy of the structure;

work chamber means in said hull means above said oil storage chamber means;

means in the work chamber means and in the variable ballast chamber means for controlling the amount of ballast in the variable ballast means;

means in the oil storage chamber means and in the work chamber means for feeding oil to said oil storage chamber means and for removing water therefrom as oil is introduced therein;

a central longitudinal passageway through the hull means;

a riser means extending into said passageway from said subsea well location and terminating at said work chamber means;

said riser means including buoyant tank means carried at the upper end thereof to maintain said riser means under tension;

means on said riser buoyant tank means and on said hull means in said central passageway for guiding relative movement between said hull means and said riser means;

said controlling means for said variable ballast chamber means being operable to maintain said floating structure under conditions of constant draft and constant distance between center of gravity and center of buoyancy to stabilize such relative movement.

2. A floating structure as stated in claim 1 wherein said storage chamber means and said variable ballast means are of prismatic shape.

3. In a structure as stated in claim 2 wherein said means for controlling said variable ballast means includes maintaining the center of gravity of the entire mass a selected distance above the bottom of the hull means.

4. In a floating structure as stated in claim 3 wherein said upper portions of said variable ballast means extend above the oil storage chamber means a height sufficient to include additional ballast means for compensating variations in the position of the center of gravity caused by loading and unloading of the production facilities.

5. In a floating structure including oil storage capacity and adapted to be anchored by catenary mooring lines at a subsea well location, the combination of:

an elongated hull means vertically positionable in water;

said hull means including an oil storage chamber means for storing oil and extending for a major portion of the height of said floating structure;

a plurality of vertically extending ballast chamber means within said hull means and extending from the bottom portion of the oil storage chamber means to above the top portion of the storage chamber means;

means in the hull means for introducing oil into the oil storage chamber means and for removing water therefrom as oil enters said storage chamber means;

and means for regulating the amount and location of ballast in the ballast chamber means to maintain a center of gravity of the entire mass at a selected location above the bottom of the hull means and at a selected distance from the center of buoyancy of the structure while the amount of oil in the oil storage chamber means changes.

6. A floating structure as stated in claim 5 wherein said oil storage chamber means and said ballast chamber means are of prismatic shape.

7. A floating structure as stated in claim 5 including fixed ballast means at the bottom said hull means;

permanent buoyant means in said hull means above said oil storage chamber means;

said vertically extending ballast means extending through said permanent buoyant means and thereabove.

8. A floating structure as stated in claim 7 including work chamber means above said permanent buoyant means in said hull means;

said vertical ballast chamber means extending into said work chamber and accessible therefrom.

9. A floating structure as stated in claim 8 including production deck means above said hull means;

and through longitudinal passageway means in said hull means and extending to said production deck means.

10. A floating structure as stated in claim 9 including riser means within said passageway means;

said riser means including riser float chamber means submerged in water in said passageway means for tensioning said riser means.

11. In a method of maintaining constant draft and constant selected distance between center of gravity and center of buoyance to provide stable motion characteristics of a spar buoy construction including a structure of fixed weight, equipment and stores thereof of variable weight, a vertically disposed oil storage chamber of selected volume and of prismatic shape, a plurality of variable ballast chambers of selected volume and of prismatic shape extending at least for the height of the oil storage chamber, and having inlet and outlet means for inflow and outflow of oil and water, said oil storage chamber being initially filled with water and establishing a center of gravity position and a selected draft of the spar buoy construction in water; the steps of:

causing oil to flow into said oil-storage chamber while displacing water therefrom;

causing water to flow into initially empty variable ballast chambers until the aggregate weight of the water in the ballast chambers and the weight of oil and water in the oil storage chamber is equivalent to the initial aggregate weight of the water-filled oil chamber;

and controlling the amount of water entering certain of said variable ballast chambers to maintain the center of gravity of the spar buoy construction at the said selected position.

12. In a method as stated in claim 11, including the step of:

controlling the volume of water introduced into said variable ballast chambers to compensate for changes in the variable weight of the equipment and the stores carried by the spar buoy construction.

13. In a method as stated in claim 11, including the step of:

filling only certain of said variable ballast tanks to a level above the oil storage chamber.

14. In a floating structure including production facilities, oil-storage facilities, and adapted to be associated with a riser system connected with a subsea well installation, the combination of:

an elongated hull means;

means for vertically positioning said hull means in water;

said hull means including a longitudinal passageway means, oil storage means of prismatic shape and surrounding the passageway means, a plurality of separate variable ballast means of prismatic shape surrounding said central passageway means, and extending from the bottom of the oil storage means to above the oil storage means;

means for filling said oil storage means with water and for removing said water as said oil storage means is filled with oil;

means for inflow and outflow of water from said variable ballast means;

a riser system extending through said central passageway means for connection to said production facilities, and to provide flow of oil from said subsea wellhead to said oil storage means;

said riser system including buoyant means for maintaining tension on said riser system, said buoyant means being located in said passageway means and providing relative movement between the upper end of said riser system and the passageway means of the hull means;

said oil storage means when filled with water establishing a center of gravity of the entire structure and a selected draft;

said inflow of oil to said oil storage means and outflow of water therefrom with resultant change in the center of gravity of the entire mass being compensated for by varying the water volume in at least certain of said variable ballast means whereby the center of gravity of the entire mass remains substantially in the same position, the draft remains substantially constant, and relative movement of the riser system in the hull means is stabilized.

15. A floating structure as stated in claim 14 including guide means on said hull means for said riser buoyant means.

16. A floating structure as stated in claim 14 wherein said riser buoyant means includes a plurality of through tubes;

a riser pipe extending through each of said through tubes;

said riser buoyant means including adjustable tension means for each of said riser pipes at the top wall of said riser buoyant means;

a deck supported from said top wall above said riser buoyant means and through which each riser pipe extends;

and articulated flexible pipe means connected to each of said riser pipes.

17. In a stabilized spar buoy construction for deep sea operations having submerged oil storage capacity, above surface construction facilities, and a riser system connecting subsea well installations with the production facilities, the combination of:

means for minimizing heave response and maintaining substantially constant draft of said spar buoy construction including an elongated submerged hull means having a selected volume and a selected water plane area, mooring means connecting the bottom portion of the hull means with the sea bottom, said spar buoy construction having a center of buoyancy;

means including oil storage chambers and variable ballasting chambers in said hull means for establishing and maintaining a constant center of gravity of said construction at a selected distance K below said center of buoyancy;

means for passing said riser system through said hull means, maintaining tension on said riser system, and minimizing pitch motions in the riser system including a submerged float chamber means having pitch oscillations of the same amplitude as the hull means, the bending stresses in said riser system between the sea floor and the float chamber means being minimized by maintaining said selected distance K under different load conditions.

* * * * *